United States Patent [19]

Spiegel et al.

[11] Patent Number: 5,011,125

[45] Date of Patent: Apr. 30, 1991

[54] DELIVERY SHEET BRAKE FOR A SHEET-FED PRINTING PRESS

[75] Inventors: Nikolaus Spiegel, Walldorf; Karl-Heinz Filsinger, Wiesloch; Roland Hirth, Römerberg, all of Fed. Rep. of Germany

[73] Assignee: Heidelberger Druckmaschinen AG, Heidelberg, Fed. Rep. of Germany

[21] Appl. No.: 426,936

[22] Filed: Oct. 25, 1989

[30] Foreign Application Priority Data

Oct. 25, 1988 [DE] Fed. Rep. of Germany ..... 3836254

[51] Int. Cl.[5] ..... B65H 29/68

[52] U.S. Cl. ..... 271/183; 271/204

[58] Field of Search ..... 271/183, 204, 103

[56] References Cited

U.S. PATENT DOCUMENTS

| | | | |
|---|---|---|---|
| Re. 25,283 | 11/1962 | Yingling | 271/183 |
| 2,130,841 | 9/1938 | Eckhard . | |
| 3,378,256 | 4/1968 | Ellis et al. . | |
| 3,702,698 | 11/1972 | Schwebel | 271/103 |

*Primary Examiner*—Richard A. Schacher

*Attorney, Agent, or Firm*—Herbert L. Lerner; Laurence A. Greenberg

[57] ABSTRACT

A delivery sheet brake for a sheet-fed printing press having a suction element for gripping a sheet at a trailing edge thereof, the suction element being disposed on an adjustable slide for format adjustment and being guidably movable on a closed path loop extending through a transfer position and a release position for the sheet, and a step-up transmission connecting the suction element to a uniformly revolving drive element disposed likewise on the slide, said transmission including an articulated lever for accelerating the suction element to sheet travel speed before it reaches the transfer position and decelerating the suction element after sheet transfer until the suction element reaches the release position, including a chain wheel connected to the drive element disposed on the adjustable slide, a drive chain directly connecting the chain wheel with a chain wheel of a drive for the printing press, and a chain-storage device for the drive chain, the chain-storage device being in cooperative engagement with the drive chain so as to compensate for changes in length of the drive chain without any phase displacement of the chain wheels.

9 Claims, 3 Drawing Sheets

DELIVERY SHEET BRAKE FOR A SHEET-FED PRINTING PRESS

The invention relates to a delivery sheet brake for a sheet-fed printing press, the delivery sheet brake having a suction element for gripping a sheet at a trailing edge thereof, the suction element being disposed on an adjustable slide for format adjustment and being guidably movable on a closed path loop extending through a transfer position and a release position for the sheet, and a step-up transmission connecting the suction element to a uniformly revolving drive element disposed likewise on the slide, the transmission including an articulating lever for accelerating the suction element to sheet travel speed before it reaches the transfer position and decelerating the suction element after sheet transfer until the suction element reaches the release position.

These generic features have become known heretofore from German Published Non-Prosecuted Application (DE-OS) 16 36 316. In this heretofore known construction, the suction element is in the form of a sucker having a carrier which is supported by a lever guide, one lever of which is connected to an eccentric of a uniformly revolving first drive element, which effects lifting and lowering movements i.e. reciprocations, of the sucker, and the other lever of which is coupled to a second drive element which causes horizontal movements of the sucker. This second drive element is formed of a cam disc against which a roller is held which is mounted on a toothed segment meshing with or engaging in a gearwheel mounted with the lever on the same shaft. Such a drive for the delivery sheet brake permits the sucker to be lifted by the one drive element against the trailing edge of the sheet, which enters the delivery more-or-less horizontally, and, simultaneously the horizontal motion of the sucker to be accelerated by the other drive element, to more-or-less sheet speed in as short a distance as possible from a starting position. After transfer of the sheet to the sucker in the transfer position, which coincides in time with the release of the sheet by the transport means of the delivery or which slightly overlaps with the latter, the sucker is lowered against the delivery pile by the first-mentioned drive element and is simultaneously decelerated in as long a distance as possible by the other drive element before the sucker releases the sheet in the release position and returns at relatively high speed to the starting position, both drive elements being mutually cooperative. Both drive elements are connected via gearwheels and drive chains to the drive of the conveyor in the delivery. The aforementioned German publication contains no details regarding adjustment of the sucker position or of the sucker drive in the event of a change in format of the sheet to be printed. Because the drive means for the sucker are form-lockingly i.e. positively, connected to the latter and, consequently, are disposed on the slide for possible format adjustment, it is necessary each time to adjust the delivery sheet brake in the event of a change in format of the sheets to be printed. This is time-consuming and, in the case of incorrect adjustments, leads to smearing and inaccurate running or travel of the paper, particularly at high printing speeds. The drives for the sucker of the delivery sheet brake which are disclosed in this German publication are very costly.

U.S. Pat. No. 2,130,841 also discloses a delivery sheet brake in which the vertical and the horizontal motions of a sucker are achieved by separate drive means. This publication also does not take into consideration any of the problems caused by changes in the format of the sheets that are to be printed.

It is accordingly an object of the invention to provide a delivery sheet brake for a sheet-fed printing press which achieves further optimization of reliable travel of the sheets in the sheet delivery independently of the nature of the sheets being printed, particularly at high press speeds, and to permit format adjustments without additional adjustment at the delivery sheet brake and without phase displacement with respect to the printing units.

With the foregoing and other objects in view, there is provided, in accordance with the invention, a delivery sheet brake for a sheet-fed printing press having a suction element for gripping a sheet at a trailing edge thereof, the suction element being disposed on an adjustable slide for format adjustment and being guidably movable on a closed path loop extending through a transfer position and a release position for the sheet, and a step-up transmission connecting the suction element to a uniformly revolving drive element disposed likewise on the slide, the transmission including an articulated lever for accelerating the suction element to sheet travel speed before it reaches the transfer position and decelerating the suction element after sheet transfer until the suction element reaches the release position, comprising a chain wheel connected to the drive element disposed on the adjustable slide, a drive chain directly connecting the chain wheel with a chain wheel of a drive for the printing-press, and a chain-storage device for the drive chain, the chain-storage device being in cooperative engagement with the drive chain so as to compensate for changes in length of the drive chain without any phase displacement of the chain wheels.

Thus, the suction element of the delivery sheet brake is driven without phase displacement directly by the drive of the printing press. This phase-neutral drive is not interrupted upon the occurrence of a format adjustment of the sheets being printed, the change in length of the drive chain between the drive element of the suction element and the printing press being compensated for by the chain-storage device. The effect of the direct connection of the drive element for the suction element to the drive of the printing press is that the speed of the suction element, matched to the sheet speed, is maintained independently of the current press speed. In the event of a format adjustment, the phase position of the suction element with respect to the trailing edge of the sheet is likewise maintained. Format adjustments and changes in the press speed can be effected with the press in operation without the phase position of the suction element in the delivery sheet brake being affected thereby, which constitutes an essential advantage of having the drive for the suction element of the delivery printing sheet brake according to the invention coming directly from the printing press.

In accordance with another feature of the invention, the drive element disposed on the slide comprises a cam disc and the step-up transmission comprises a roller engaging the cam disc under spring tension, and including a plurality of levers of varying length, the levers being hinge-connected at one end thereof to one another and, at the other end thereof, being also mounted on the slide, one of the levers carrying the roller. Thus, a cam disc forms the drive element for the suction element, a roller being held under spring biasing against the cam disc, the movements of the roller being transmitted by means of a step-up transmission to the suction element, which is mounted on the slide for format adjustment so as to be movable about a transverse axis.

In accordance with a further feature of the invention, the step-up transmission is formed as a lever transmission comprising four linkage joints, two of the linkage joints being fixed on the slide for format adjustment and forming pivot bearings for one end, respectively, of a first and a second lever, the first and second levers having other ends, respectively, forming the other two of the linkage joints with and movably connected to one another by a third lever, one of the first and second levers being rigidly attached by one of the joints fixed on the slide to a support bearing, the support bearing carrying a roller in engagement with a cam disc, the other of the first and second levers being rigidly attached to a shaft, the shaft being mounted on the slide and having an axis transverse to the direction of travel of the sheet to the delivery. Such a four-linkage joint drive unit formed of hinge-connected levers is relatively economical to manufacture, is operationally reliable and permits relatively high transmission ratios with relatively small overall size.

The combination of the cam roller and the cam guide for the cam roller with a four-linkage joint drive unit provides further advantage because of the high transmission ratio which is attainable, that the suction element, particularly a sucker or even a plurality of suckers, contacts the sheet once only per revolution of the printing press.

In accordance with an added feature of the invention, the drive chain is loop-shaped and formed with two stringers, and the chain-storage device comprises deflector rollers for both of the stringers of the drive chain, the deflector rollers being biased towards the outside by spring force acting transversely to directions of travel of the chain stringers.

In accordance with a further feature of the invention, the deflector rollers for both of the chain stringers are mounted on respective carriers, and a parallel guide is included connecting the carriers to one another.

In accordance with still another feature of the invention, the parallel guide comprises at least one cross-scissors unit having respective ends at one side thereof connected to one of the carriers, and respective ends at an opposite side thereof connected to the other of the carriers for guiding the carriers so that they are displaceable parallel to one another.

In accordance with still an added feature of the invention, there are provided helical springs engaging the carriers for spring-loading the carriers away from one another.

In accordance with concomitant alternate features of the invention, the suction element may be formed either by a suction disc or by a reciprocating sucker which does not require its own drive means for the reciprocating motion. A reciprocating movement of the sucker, if necessary or desired, may be effected directly by the vacuum in the sucker and can be controlled by the engagement of the sheet with the sucker.

Other features which are considered as characteristic for the invention are set forth in the appended claims.

Although the invention is illustrated and described herein as embodied in a delivery sheet brake for sheet-fed printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
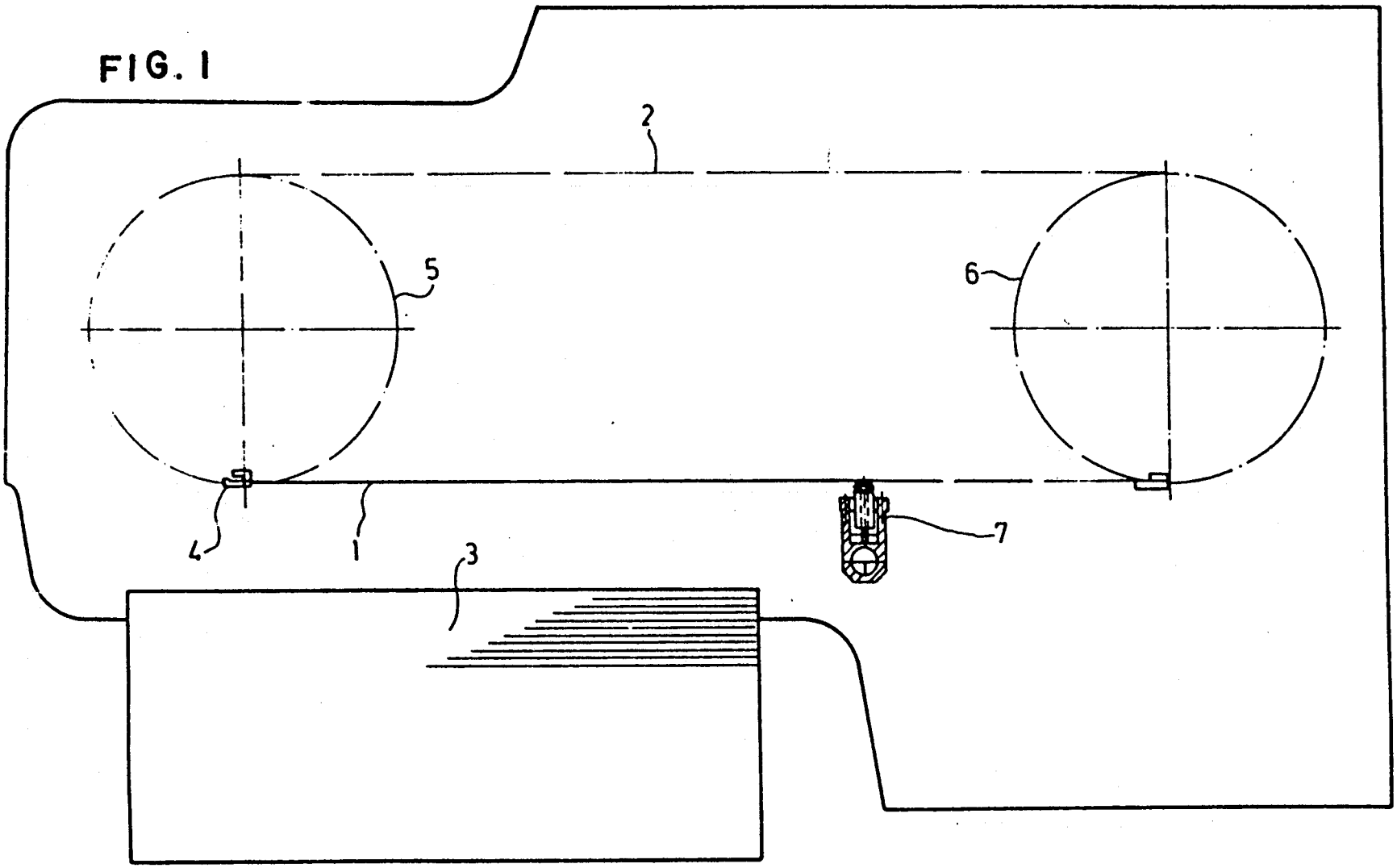
FIG. 1 is a diagrammatic side elevational view of a sheet delivery with a delivery sheet brake formed with a suction element.

Referring now to the drawing and, first, particularly to FIG. 1 thereof, there is shown therein a sheet 1 arriving from a printing press which is transported over a delivery pile 3 by a conveying chain 2, the sheet 1 being gripped at a leading edge thereof by grippers 4 on the conveying chain 2, the latter being guided by deflectors in the form of reversing rollers 5 and 6. The sheet 1 is guided somewhat horizontally to the delivery. At the end of this movement, a suction element 7 engages the trailing edge of the sheet 1 which, simultaneously or with a slight overlap in time, is released by the grippers 4 of the conveying chain 2, so that the sheet 1 is lowered to the sheet pile and , accordingly, decelerated by the motion of the suction element 7 and finally deposited gently onto the pile of sheets 3. This deceleration of the sheet is intended to take place over as long a path as possible so that the suction element has to be accelerated up to the speed of the sheet in as short a distance as possible, so that it can take the sheet over without any difference in speed relative to the sheet and so that it returns at low speed to the starting position when it has released the sheet for deposit upon the delivery pile. This movement is achieved by a drive element formed of a cam disc 8, which is mounted in a slide 9 so as to be rotatable about a horizontal shaft, the slide 9 bearing all the parts for format adjustment and its horizontal adjustment capability being illustrated by the circles symbolically indicated on the underside of the slide 9. Also disposed on the slide 9 is the suction element 7, which is movable about a shaft 11 disposed so that its axis is parallel to the rotational axis 10. A roller 12 is pressed in known manner by spring force e.g. by a tension spring 36 according to FIG. 2, against the circumference of the cam disc 8, the roller 12 being mounted at the free end of a short lever 13 of a four-link drive formed of a plurality of levers, the drive forming a step-up transmission. Another lever 14 is rigidly connected to the shaft 11. Its free end is connected in a joint 17*a* to one end of a lever 15, the other end of which is connected in a joint 17*b* to a lever 16, which has a rigid connection to the lever 13 bracing the mounting of the roller 12. The levers 13 and 16 may also be of one-piece or integral construction. The two levers 13 and 16 have a common joint 17*c*, which is disposed on the slide 9. The lever 14 is also disposed with its joint 17*d* on the slide 9 via the shaft 11. By suitable coordination of the lever lengths, it is possible to achieve wide ranges of transmission ratios by relatively simple means.

Rigidly connected to the cam disc 8 is a chain wheel 18, which is driven by a drive chain 19 directly from a chain wheel 20 of the printing-press drive. The drive chain 19 passes through a chain-storage device 21, which holds both chain stringers or runs 19*a* and 19*b* under uniform tension. Thus, the chain wheel 18 on the cam disc 8 can be adjusted at a distance from the chain wheel 20, while the phase position between the two chain wheels 18 and 20 is maintained, however. This permits format adjustments and changes in speed of the printing press without influencing the adjusted position and movement of the suction element 7 of the delivery sheet brake.

In the embodiment of the chain-storage device 21 shown in the drawing, both chain stringers 19*a* and 19*b* are guided over a plurality of deflector or reversing rollers 22 and 23, with the chain stringers 19*a* and 29*b*, respectively, alternately winding partly around the rollers 22 and 23 respectively assigned thereto. The rollers 22 supporting the one chain stringer 19*a* are mounted on a common carrier 24 and the rollers 23 supporting the other chain stringer 19*b* are mounted on a common carrier 25, the two carriers 24 and 25 being forced apart by helical springs 26 and 27 and by at least one cross-scissors unit 33 formed of two straps articulatingly connected to one another at a center 34 thereof, the one ends of said straps at the one carrier, and the opposite ends of the straps at the other carrier being displaceably guided parallel to one another, with the parallel position of the guides being maintained in relation to one another. The two helical springs 26 and 27 disposed at the ends of the carriers 24 and 25 force the carriers 24 and 25 apart and thus effect a constantly uniform tensioning of the conveying chain 19 and compensate for changes in the spacing between the two chain wheels 18 and 20 without phase displacement.

Figure 2:
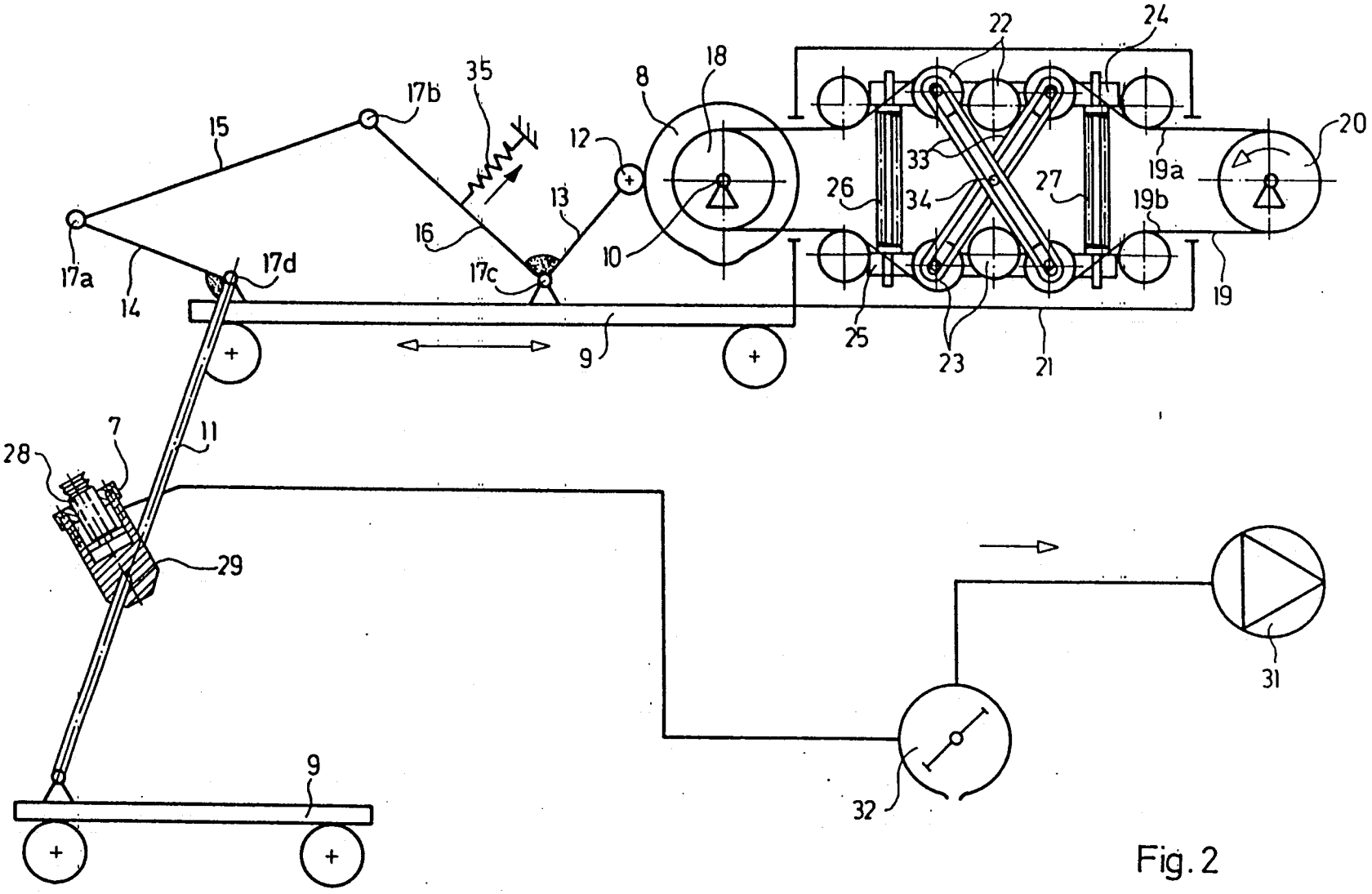
FIG. 2 is a diagrammatic view of a drive for a sucker forming the suction element.

FIG. 2 shows a suction element 7 formed of at least one sucker 28 and a housing 29, which guides the sucker 28 in a longitudinal movement, so that the sucker 28 is extensible out of the housing and retractable into the housing. This movement is effected by the vacuum in the line to the sucker 28 and is controlled by contact of the sheet 1 with the sucker 28. In the acceleration phase, the sucker 28 is extended out of the housing, this movement being effected, for example, by centrifugal force or also by the vacuum in the suction line connected to a vacuum pump 31. The instant the sucker 28 has gripped the trailing edge of the sheet 1, and the suction opening of the sucker 28 has been closed by the sheet 1, the vacuum in the line to the sucker 28 pulls the sheet 1 into the housing. This lowering or dropping movement of the sucker 28 lengthens the distance traveled during the deceleration phase, because the suction opening of the sucker 28 moves on an elliptical path. After the release of the sheet 1 by the sucker 28, the suction element 7 returns to the starting position thereof and is then again accelerated to the transfer position in order to intercept or take over the next sheet. The suction-gripping of the sheet 1 and the release of the latter may be effected in a conventional manner, for example by means of a rotary valve 32 driven by the printing press.

Figure 3:
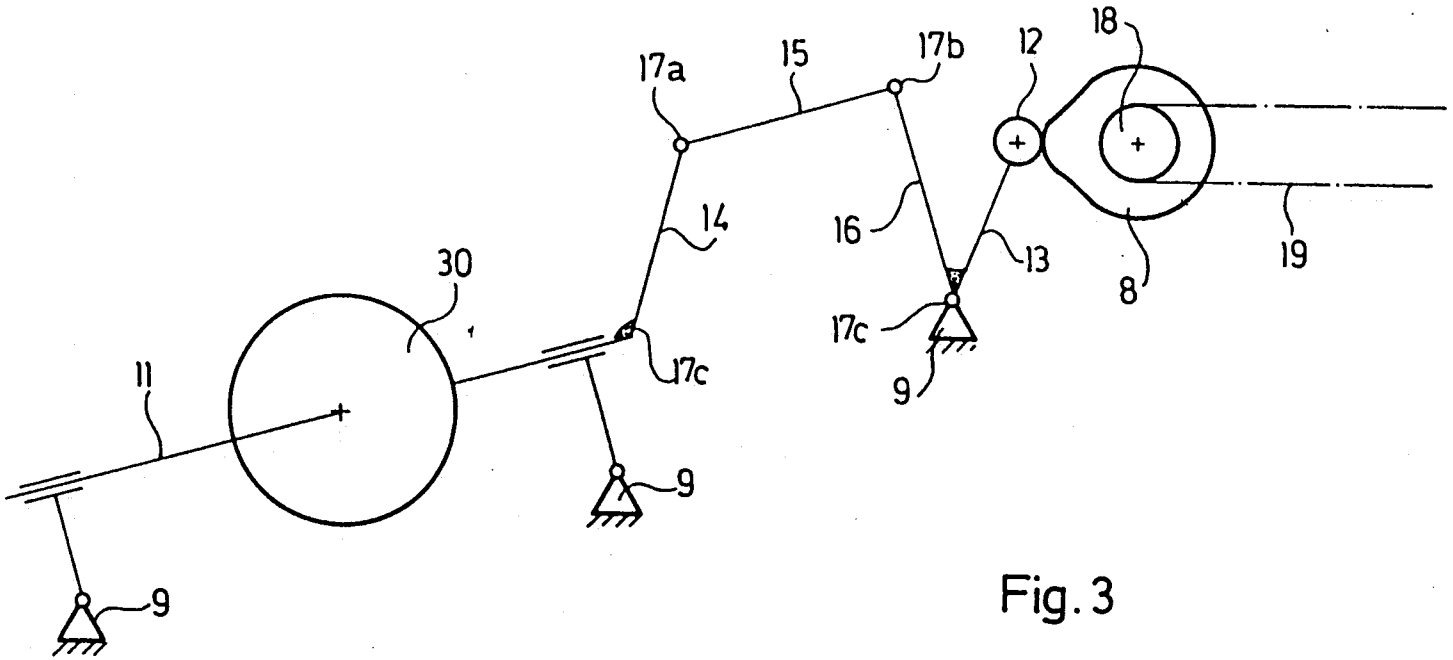
FIG. 3 is a diagrammatic view of a drive for a suction disc forming the suction element.

In the embodiment of the invention shown in FIG. 3, the sucker is replaced by a suction disc 30, which is mounted on the shaft 11 instead of the housing 29 of the sucker 28. Such a suction disc 30 is also moved by a step-up transmission formed of a plurality of levers 13, 14, 15 and 16 connected to one another by respective joints 17*a*, 17*b*, 17*c* and 17*d*, via a roller 12 by a revolvingly driven cam disc 8. Such a drive may, however, also be replaced by an electric drive motor for the suction disc 30 with control by means of an angle-of-rotation receiver or pickup, which is disposed directly on the printing press, the motor being connected directly or via a gear unit or transmission to the suction disc 30.

The foregoing is a description corresponding in substance to German Application P 38 36 254.6, dated Oct. 25, 1988, the International priority of which is being claimed for the instant application, and which is hereby made part of this application. Any material discrepancies between the foregoing specification and the aforementioned corresponding German application are to be resolved in favor of the latter.

We claim:

1. Delivery sheet brake for a sheet-fed printing press having a suction element for gripping a sheet at a trailing edge thereof, the suction element being disposed on an adjustable slide for format adjustment and being guidably movable on a closed path loop extending through a transfer position and a release position for the sheet, and a step-up transmission connecting the suction element to a uniformly revolving drive element disposed likewise on the slide, said transmission including an articulated lever for accelerating the suction element to sheet travel speed before it reaches the transfer position and decelerating the suction element after sheet transfer until the suction element reaches the release position, comprising a chain wheel connected to the drive element disposed on the adjustable slide, a drive chain directly connecting said chain wheel with a chain wheel of a drive for the printing press, and a chain-storage device for said drive chain, said chain-storage device being in cooperative engagement with said drive chain so as to compensate for changes in length of said drive chain without any phase displacement of said chain wheels.

2. Delivery sheet brake according to claim 1, wherein the drive element disposed on the slide comprises a cam disc and the step-up transmission comprises a roller engaging said cam disc under spring tension, and including a plurality of levers of varying length, said levers being hinge-connected at one end thereof to one another and, at the other end thereof, being also mounted on the slide, one of said levers carrying said roller.

3. Delivery sheet brake according to claim 1, wherein said drive chain is loop-shaped and formed with two stringers, and said chain-storage device comprises deflector rollers for both of said stringers of said drive chain, said deflector rollers being biased towards the outside by spring force acting transversely to directions of travel of said chain stringers.

4. Delivery sheet brake according to claim 3, wherein said deflector rollers for both of said chain stringers are mounted on respective carriers, and including a parallel guide connecting said carriers to one another.

5. Delivery sheet brake according to claim 4, wherein said parallel guide comprises at least one cross-scissors unit having respective ends at one side thereof connected to one of said carriers, and respective ends at an opposite side thereof connected to the other of said carriers for guiding said carriers so that they are displaceable parallel to one another.

6. Delivery sheet brake according to claim 4, including helical springs engaging said carriers for spring-loading said carriers away from one another.

7. Delivery sheet brake according to claim 1, wherein the step-up transmission is formed as a lever transmission comprising four linkage joints, two of said linkage joints being fixed on the slide for format adjustment and forming pivot bearings for one end, respectively, of a first and a second lever, said first and second levers having other ends, respectively, forming the other two of said linkage joints with and movably connected to one another by a third lever, one of said first and second levers being rigidly attached by one of said joints fixed on the slide to a support bearing, said support bearing carrying a roller in engagement with a cam disc, the other of said first and second levers being rigidly attached to a shaft, said shaft being mounted on the slide and having an axis transverse to the direction of travel of the sheet to the delivery.

8. Delivery sheet brake according to claim 1, wherein the suction element is at least one suction disc.

9. Delivery sheet brake according to claim 1, wherein the suction element is at least one sucker connected to the step-up transmission and guidable so that it is lifted and lowered in relation to a pivot-mounted shaft.

* * * * *

UNITED STATES PATENT AND TRADEMARK OFFICE

CERTIFICATE OF CORRECTION

PATENT NO. : 5,011,125

DATED : Apr. 30, 1991

INVENTOR(S) : Spiegel et al

It is certified that error appears in the above-identified patent and that said Letters Patent is hereby corrected as shown below:

In the title page, item [21] "Appl. No.: "426,936" should read --Appl. No.: 426,963--.

Signed and Sealed this

Eighth Day of September, 1992

*Attest:*

DOUGLAS B. COMER

*Attesting Officer*

*Acting Commissioner of Patents and Trademarks*